US008701291B2

(12) United States Patent
Hirano

(10) Patent No.: US 8,701,291 B2
(45) Date of Patent: Apr. 22, 2014

(54) MULTI-PURPOSE HAIR CUTTER

(75) Inventor: Toru Hirano, Atami (JP)

(73) Assignee: Tokyo Riki Co., Ltd., Tokyo (JP)

( * ) Notice: Subject to any disclaimer, the term of this patent is extended or adjusted under 35 U.S.C. 154(b) by 301 days.

(21) Appl. No.: 12/942,438

(22) Filed: Nov. 9, 2010

(65) Prior Publication Data

US 2011/0131811 A1 Jun. 9, 2011

(30) Foreign Application Priority Data

Dec. 3, 2009 (JP) ..... 2009-275484

(51) Int. Cl.
*B26B 21/10* (2006.01)
*A45D 24/36* (2006.01)

(52) U.S. Cl.
USPC ..... 30/30; 30/51; 30/53; 30/55; 30/298; 132/213.1

(58) Field of Classification Search
USPC ..... 30/30, 51, 53, 54, 55, 286, 295, 298; 132/213.1
See application file for complete search history.

(56) References Cited

U.S. PATENT DOCUMENTS

| | | | | | |
|---|---|---|---|---|---|
| 1,654,117 | A | * | 12/1927 | Durlacher | 132/120 |
| 2,288,299 | A | | 6/1942 | Pileggi | |
| 3,134,382 | A | * | 5/1964 | Broman | 132/213.1 |
| 3,536,080 | A | * | 10/1970 | Legan et al. | 132/213.1 |
| 3,990,461 | A | * | 11/1976 | Katz | 132/313 |
| 4,009,517 | A | * | 3/1977 | Horn | 30/30 |
| 4,037,322 | A | * | 7/1977 | Bresler | 30/53 |
| 4,344,226 | A | * | 8/1982 | Blake, III | 30/31 |
| 4,401,129 | A | * | 8/1983 | Luque | 132/213.1 |
| 4,487,211 | A | * | 12/1984 | Sullivan | 132/213.1 |
| 4,542,585 | A | * | 9/1985 | Ito et al. | 30/210 |
| 4,709,475 | A | * | 12/1987 | Phung | 30/31 |
| 5,009,003 | A | * | 4/1991 | Grange | 30/30 |
| 5,146,810 | A | * | 9/1992 | Mueller | 74/558 |
| 5,794,348 | A | * | 8/1998 | Scott | 30/195 |
| 6,092,288 | A | * | 7/2000 | Adachi | 30/53 |
| 6,381,855 | B1 | * | 5/2002 | Lin | 30/295 |
| 6,588,108 | B2 | * | 7/2003 | Talavera | 30/133 |
| 7,856,720 | B2 | * | 12/2010 | Okaniwa | 30/30 |
| 2006/0130334 | A1 | * | 6/2006 | Park | 30/30 |
| 2009/0142463 | A1 | * | 6/2009 | Hayes | 426/518 |

FOREIGN PATENT DOCUMENTS

| | | |
|---|---|---|
| JP | 3182554 | 4/2001 |

OTHER PUBLICATIONS

Office Action issued Dec. 4, 2013 in Chinese Patent Application No. 201010556519.X.

* cited by examiner

*Primary Examiner* — Hwei C Payer
(74) *Attorney, Agent, or Firm* — Oblon, Spivak, McClelland, Maier & Neustadt, L.L.P.

(57) ABSTRACT

A multi-purpose hair cutter according to the present invention includes a body member, a blade member, and a projection member. The blade member is attached to a first side of the body member in a height direction. The projection member has a base part and at least one projecting part. The base part is attached to a second side of the body member opposite to the blade member in the height direction. The projecting part is formed to project from the base part and rises in a direction opposite to the blade member.

4 Claims, 21 Drawing Sheets

MULTI-PURPOSE HAIR CUTTER

TECHNICAL FIELD

The present invention relates to a hair cutter and particularly relates to a multi-purpose hair cutter having many functions.

BACKGROUND OF THE INVENTION

As one of hairdressing tools important for hairdressers or hair stylists, there has been known a hair cutter such as disclosed in Japanese Patent No. 3182554.

The hair cutter of this type makes it possible to realize a variety of hair designs with a haircut method different from that for a conventional hairdressing scissors. In a stroke cut using a hair cutter, for example, an adequate amount of hair is first brushed into a hair bundle using a comb or the like, and the obtained hair bundle is then held with the left hand and the held hair bundle is downwardly combed and thinned by moving the hair cutter up and down with the right hand. This stroke cut makes it possible to comb and thin the hair at an angle following the natural direction of the hair.

In the above stroke cut, however, it is sometimes required to leave a part of the hair bundle uncut so as to make the cut line uneven for achieving a dynamic hair design. In this case, conventionally, a part of the hair bundle held with the left hand is put aside with the right hand.

In such a work procedure, however, the back-and-forth movement of the hair cutter is temporarily interrupted upon putting aside a part of the hair bundle, decreasing work efficiency.

SUMMARY OF THE INVENTION

It is an object of the present invention to provide a multi-purpose hair cutter suitable for achieving a variety of hair designs.

It is another object of the present invention is to provide a multi-purpose hair cutter capable of improving work efficiency.

In order to achieve the above object, a multi-purpose hair cutter according to the present invention comprises a body member, a blade member, and a projection member. The blade member is attached to a first side of the body member in a height direction. The projection member has a base part and at least one projecting part. The base part is attached to a second side of the body member opposite to the blade member in the height direction. The projecting part is formed to project from the base part and rises in a direction opposite to the blade member.

Since the blade member is attached to one side of the body member in the height direction, as described above, the multi-purpose hair cutter according to the present invention permits cutting works according to a conventional technique, such as a stroke cut, in which a part of a hair bundle held with the left hand is cut by the blade member upon swinging down the multi-purpose hair cutter held with the right hand, for example.

One feature of the present invention resides in that the projection member is provided in addition to the above-mentioned basic hair cutter structure. More specifically, the base part of the projection member is attached to the other side of the body member opposite to the blade member in the height direction, while the projecting part is formed to project from the base part and rises in a direction opposite to the blade member. With this structure, a part of the hair bundle held with the left hand, which should be left uncut, can be put aside in the above stroke cut by catching it with the projecting part upon swinging up the multi-purpose hair cutter held with the right hand. Accordingly, the multi-purpose hair cutter according to the present invention does not have a disadvantage of temporarily interrupting the up-and-down movement, improving the cutting work efficiency.

The other objects, constructions and advantages of the present invention will be further detailed below with reference to the attached drawings. However, the attached drawings show only illustrative examples.

DESCRIPTION OF THE PREFERRED EMBODIMENTS

In FIGS. 1 to 22, the same or corresponding portions are indicated by the same symbols. Throughout the description with reference to FIGS. 1 to 22, since the longitudinal direction of the body member, the longitudinal direction of the blade member, the longitudinal direction of the projection member, and the longitudinal direction of the finger rest member all coincide with each other, they are all indicated by a symbol L. Also, since the lateral direction of the blade member, the height direction of the projection member, and the height direction of the finger rest member all coincide with each other, they are all indicated by a symbol T. Moreover, since the width direction of the body member, the width direction of the blade protector, the width direction of the projection member, and the radial direction of the finger rest member all coincide with each other, they are all indicated by a symbol W.

Figure 1A:
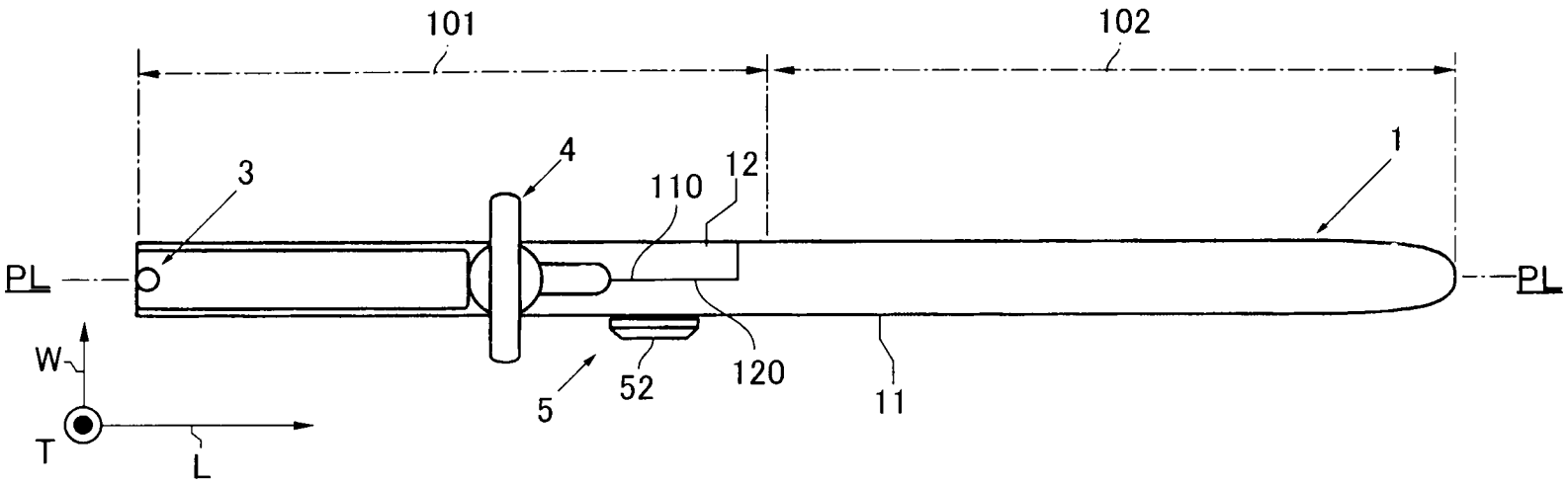
FIG. 1(*a*) is a plan view of a multi-purpose hair cutter according to one embodiment of the present invention, and FIG. 1(*b*) is a front view of the same multi-purpose hair cutter.
Figure 1B:
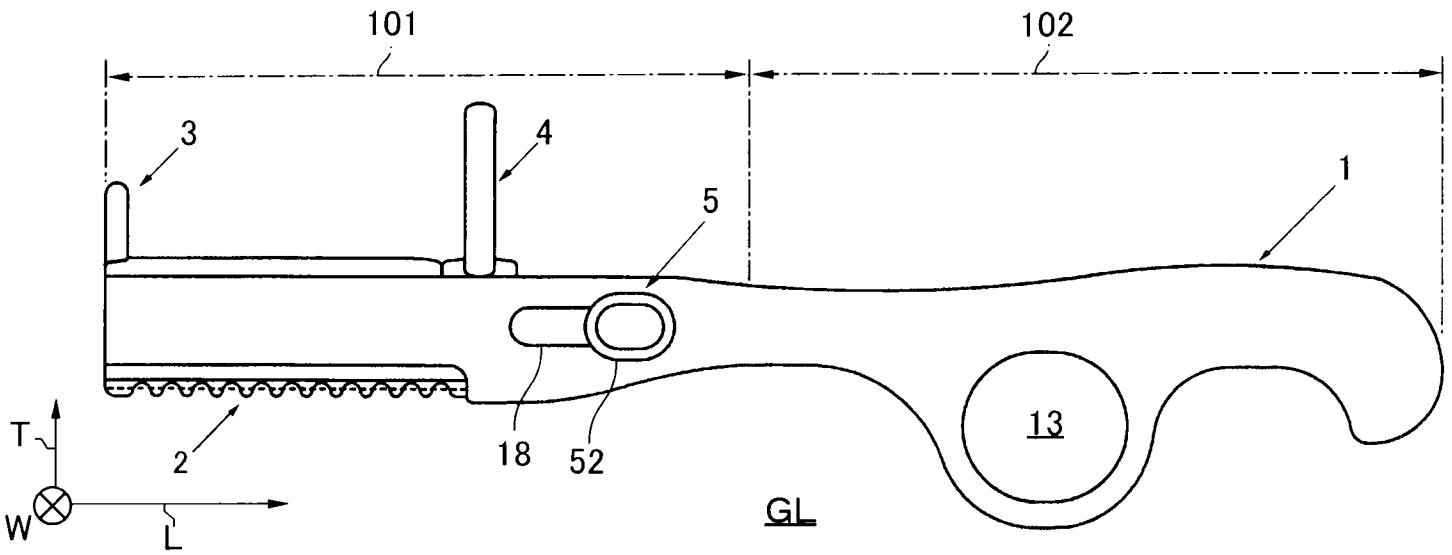

The multi-purpose hair cutter of FIGS. 1(*a*) and 1(*b*) includes a body member 1, a blade member 2, a projection member 3, a finger rest member 4, and a slide member 5. The body member 1 has a front end portion 101 and a rear end portion 102. The front end portion 101 refers to a portion extending from a midway position to one end of the body member 1 as seen in the longitudinal direction L and is equipped with the blade member 2, the projection member 3, the finger rest member 4, and the slide member 5. The rear end portion 102 refers to a portion extending from the midway position to the other end of the body member 1 as seen in the longitudinal direction L and forms a grip of the hair cutter.

Referring to FIGS. 1(*a*) and 1(*b*), furthermore, the body member 1 has a first body part 11 and a second body part 12. The first and second body parts 11, 12 are each a die-casting product made by die molding or a resin product made by injection molding. Materials to be used for the first and second body parts 11, 12 may be properly selected in view of lightness, material cost, and corrosion resistance. For example, in the case where the first and second body parts 11, 12 are a die-casting product, preferred is aluminum (Al), an aluminum alloy, or the like, while in the case of a resin product, preferred is polycarbonate (PC) or the like.

The first body part 11 has an inner face 110 at a portion corresponding to the front end portion 101. The inner face 110 is a recessed stepped face located at one side in the width direction W crossing the longitudinal direction L and is to be combined with an inner face 120 of the second body part 12 to thereby form attachment areas for the blade member 2, the projection member 3, the finger rest member 4, and the slide member 5 between their opposing surfaces. In other words, the body member 1 has a halved structure composed of a combination of the first and second body parts 11, 12 in order to form the attachment areas for the blade member 2, the projection member 3, the finger rest member 4, and the slide member 5. The internal structure of the front end portion 101 will be described later with reference to FIGS. 5 to 8.

The first body part 11 has a ring-shaped opening 13 at a portion corresponding to the rear end portion 102. The ring-shaped opening 13 is provided in view of holdability and handleability and has a sufficiently large inner diameter to permit insertion of at least one finger.

Figure 2A:
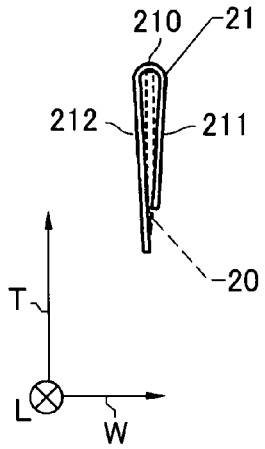
FIG. 2(*a*) is a left side view selectively showing a blade member in FIG. 1, and FIG. 2(*b*) is a front view of the same blade member.
Figure 2B:
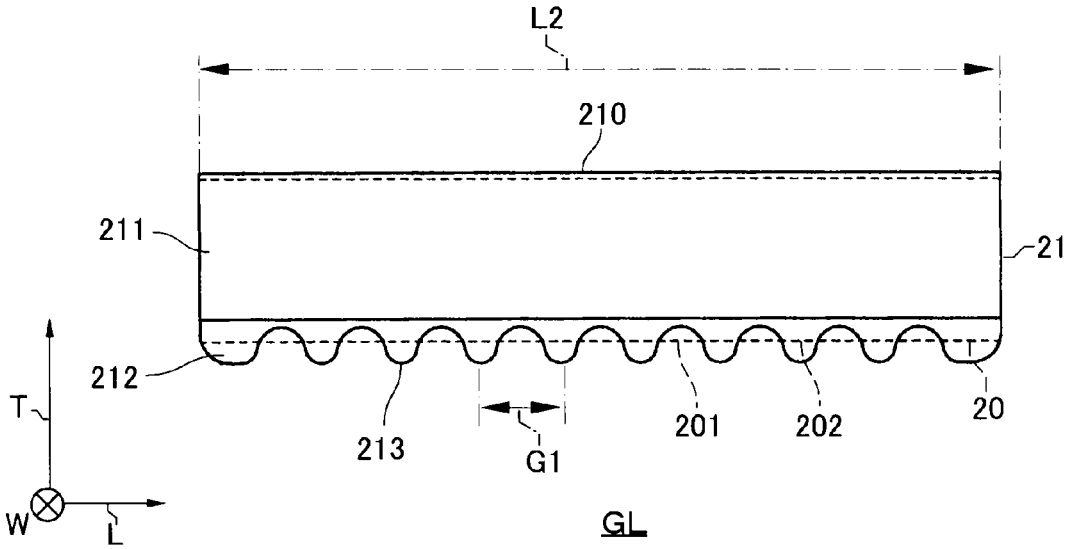

The blade member 2 has a blade 20 and a blade protector 21, as selectively shown in FIGS. 2(*a*) and 2(*b*). The blade 20 is a metallic thin piece having a rectangular shape as seen from the front, of which a longitudinal edge appearing at one side in the lateral direction T crossing the longitudinal direction L forms a sharp cutting edge. A length L2 of the blade member 2 is preferably from 40 to 60 mm, more preferably from 45 to 55 mm. However, the length L2 may properly be determined depending on the intended use of the multi-purpose hair cutter. In the case where the multi-purpose hair cutter is mainly intended for the stroke cut, for example, the length L2 is preferably about 45 mm.

The blade protector 21 is formed by folding a single metallic thin plate to have a folded portion 210 and two clamping plate portions 211, 212. The two clamping plate portions 211, 212 are opposed to each other in the width direction W through the folded portion 210. Each of the clamping plate portions 211, 212 has a generally rectangular shape whose size is almost the same as or slightly larger than the blade 20. The blade protector 21 holds the blade 20, which is introduced into a space between the opposing surfaces of the two clamping plate portions 211, 212, between the clamping plate portions 211, 212.

The clamping plate portion 212 has a longitudinal edge projecting from the clamping plate portion 211 as seen in the lateral direction T. Moreover, the longitudinal edge of the clamping plate portion 212 appearing at one side in the lateral direction T forms an array of comb-like teeth 213. The array of comb-like teeth 213 has a gap G1 between adjacent comb-like teeth 213 in the longitudinal direction L. The comb-like teeth 213 are laid on one surface of the blade 20, and in this overlapping state, the cutting edge of the blade 20 is alternately covered with the array of the comb-like teeth 213, whereby the cutting edge has exposed portions 201 and unexposed portions 202.

Figure 3A:
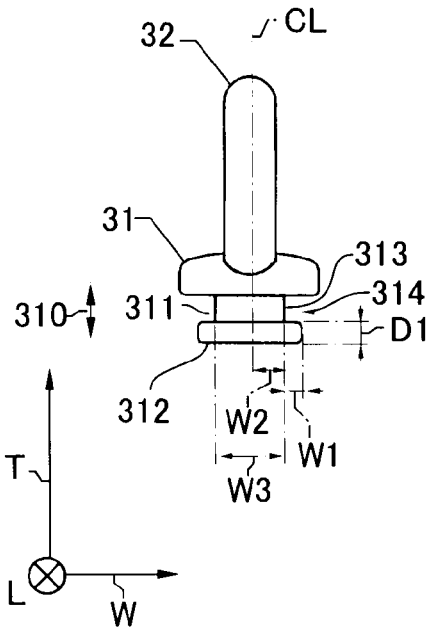
FIG. 3(*a*) is a left side view selectively showing a projection member in FIG. 1, and FIG. 3(*b*) is a front view of the same projection member.
Figure 3B:
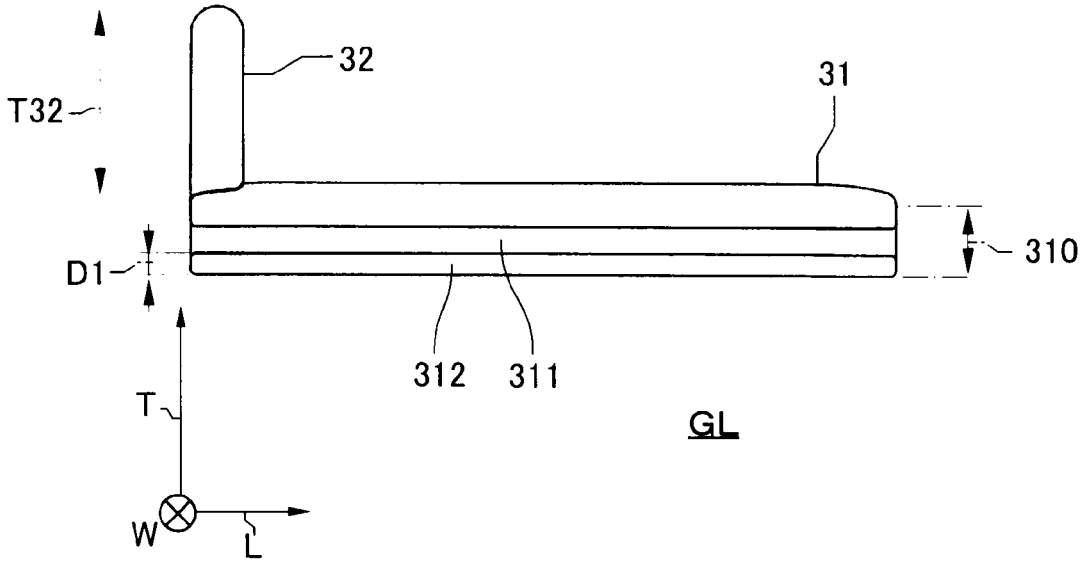

The projection member 3 is integrally molded of a synthetic resin such as AS resin (AS), ABS resin (ABS), polycarbonate (PC), polyethylene (PE), and polypropylene (PP) to have a base part 31 and one projecting part 32, as selectively shown in FIGS. 3(*a*) and 3(*b*).

The base part 31 is a rod-like member extending along the longitudinal direction L and has side faces 310 at opposite sides in the width direction W crossing the longitudinal direction L. Each of the side faces 310 has a recess 311 and a protrusion 312 at its lower portion as seen in the height direction T.

The recess 311 has a bottom 313 and an opening 314 and extends in the form of a groove in the side face 310 along the longitudinal direction L to have notch-like openings at opposite end faces in the longitudinal direction L. The opening 314 opens at a position spaced a distance D1 apart from the lower side of the side face 310 in the height direction T and is opposed to the bottom 313 in the width direction W. The bottom 313 is formed at a position spaced a width W2 apart from a centerline CL and set back from the side face 310 by W1 in the width direction W.

The protrusion 312 appears in the side face 310 over the distance D1 and has a projection height W1 corresponding to a difference in position between the side face 310 and the bottom 313. In other words, at the lower portion of the side face 310 as seen in the height direction T and at a position spaced the distance D1 apart from the lower side in the height direction T, the base part 31 has a constricted portion (width W3) corresponding to a difference in position between the side face 310 and the bottom 313.

The projecting part 32 is formed to project from one end of the base part 31 in the longitudinal direction L at its upper portion in the height direction T and rises in the height direction T opposite to the cutting edge. A height T32 of the projecting part 32 in FIG. 3(*b*) is 10 mm. However, the number and the height of projecting parts 32 to be arranged may be properly determined depending on the intended use.

Figure 4A:
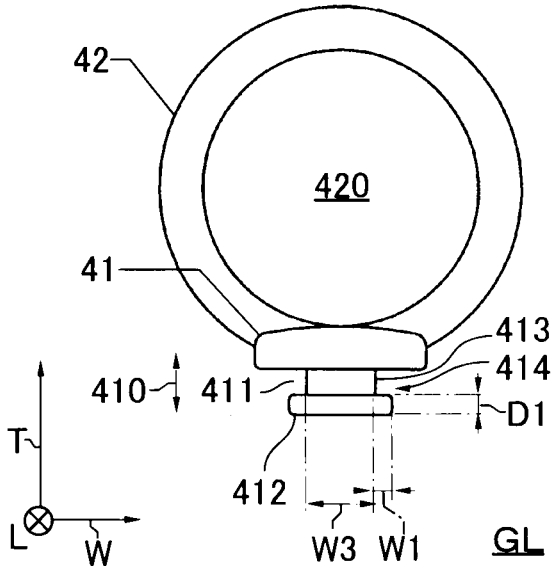
FIG. 4(*a*) is a left side view selectively showing a finger rest member in FIG. 1, FIG. 4(*b*) is a bottom view of the same finger rest member, and FIG. 4(*c*) is a partially sectional view of the same finger rest member.
Figure 4B:
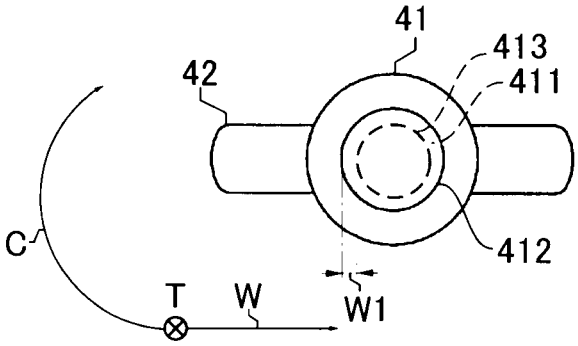
Figure 4C:
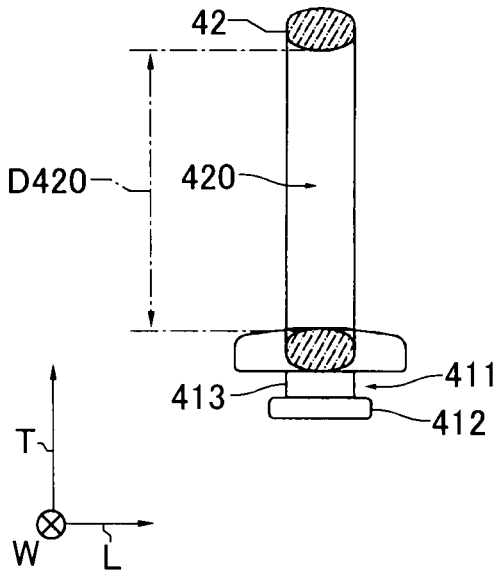
Figure 5:
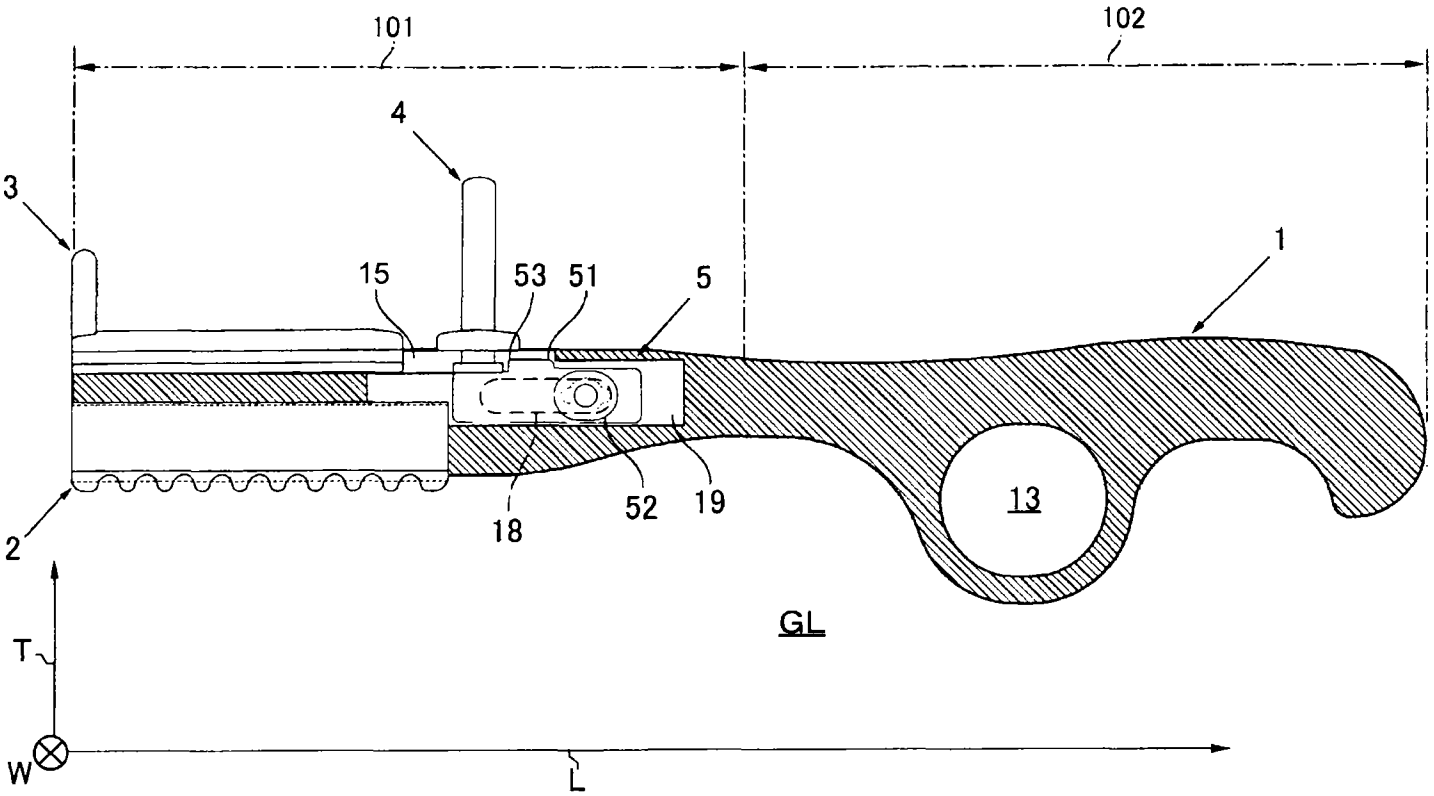
FIG. 5 is a partially sectional view of the multi-purpose hair cutter in FIG. 1.

The finger rest member 4 is integrally molded of a synthetic resin such as AS resin (AS), ABS resin (ABS), polycarbonate (PC), polyethylene (PE), and polypropylene (PP) to have a base part 41 and a ring part 42, as selectively shown in FIGS. 4(*a*) to 4(*c*).

The base part 41 has a generally cylindrical shape or a generally disk shape including a recess 411 and a protrusion 412 at a lower portion of a circumferential face 410 as seen in the height direction T crossing a circumferential direction C.

The recess 411 has a bottom 413 and an opening 414 and extends along the circumferential direction C in the circumferential face 410. The opening 414 opens at a position spaced the distance D1 apart from the lower end of the circumferential face 410 in the height direction T and is opposed to the bottom 413 in the radial direction W. The bottom 413 is set back from the circumferential face 410 by the size W1 in the radial direction W.

The protrusion 412 appears in the circumferential face 410 over the distance D1 and has a projection height W1 corresponding to a difference in position between the circumferential face 410 and the bottom 413. In other words, at the lower portion of the base part 41 in the height direction T and at a position spaced the distance D1 apart from the lower side of the circumferential face 410 in the height direction T, the base part 41 has a constricted portion (width W3) corresponding to a difference in position between the circumferential face 410 and the bottom 413. Referring to FIGS. 3(*a*) and 3(*b*) and FIGS. 4(*a*) to 4(*c*), the base part 31 and the base part 41 have substantially the same constricted portion (311, 411) at the lower portion, and the constricted portion 311 and the constricted portion 411 overlap each other as seen in the longitudinal direction L.

The ring part 42 has a through hole 420 and is formed to project from the top side of the base part 41 in the height direction T and rises in the height direction T. The ring part 42 is preferably coupled to the base part 41 movably in the circumferential direction C and/or in the radial direction W. Since the through hole 420 is provided for insertion of a finger of a hair cutter's user, an inner diameter D420 is properly determined within the range of 16 to 23 mm depending on an expected user's finger thickness. In the case where the multipurpose hair cutter is sold to male hairdressers, for example, the inner diameter D420 may be large.

The blade member 2, the projection member 3, the finger rest member 4, and the slide member 5 thus far described with reference to FIGS. 2 to 4 are attached to the front end portion 101. Next will be described the internal structure of the front end portion 101 with reference to FIGS. 5 to 8.

At the front end portion 101, the body member 1 of FIGS. 5 to 8 has a first storage 14 and a second storage 15. The first storage 14 extends along the longitudinal direction L at the lower portion of the front end portion 101 as seen in the height direction T and the blade member 2 is detachably attached thereto. The first storage 14 has a storage space 140 and an open end 141 leading to the storage space 140.

The storage space 140 is defined by the inner faces 110, 120 opposed to each other in the width direction W. The inner faces 110, 120 extend in a curved manner from the lower side as seen in the height direction T to a position spaced a distance D2 apart therefrom to have a gap G2 from the starting point to the ending point of the curved surface. In short, the inner faces 110, 120 are curved to conform to the contour of the blade member 2.

The open end 141 is in the form of a slit and extends along the longitudinal direction L at the lower side of the front end portion 101. The open end 141 is defined by the lower side of the inner face 110 and the lower side of the inner face 120 as seen in the height direction T, and these lower sides of the inner faces 110, 120 are opposed to each other in the width direction W across a gap which is twice the gap G2. The blade member 2 is detachably press-fitted into the storage space 140, and in this press-fitted state, the cutting edge of the blade member 20 is exposed to the outside through the open end 141.

The second storage 15 is in the form of a groove and extends along the longitudinal direction L in the front end portion 101 at the side opposite to the first storage 14 as seen in the height direction T, and the projection member 3 and the finger rest member 4 are detachably attached thereto in the above-mentioned order. The second storage 15 has a storage space 150 and an open end 151 leading to the storage space 150.

Figure 7:
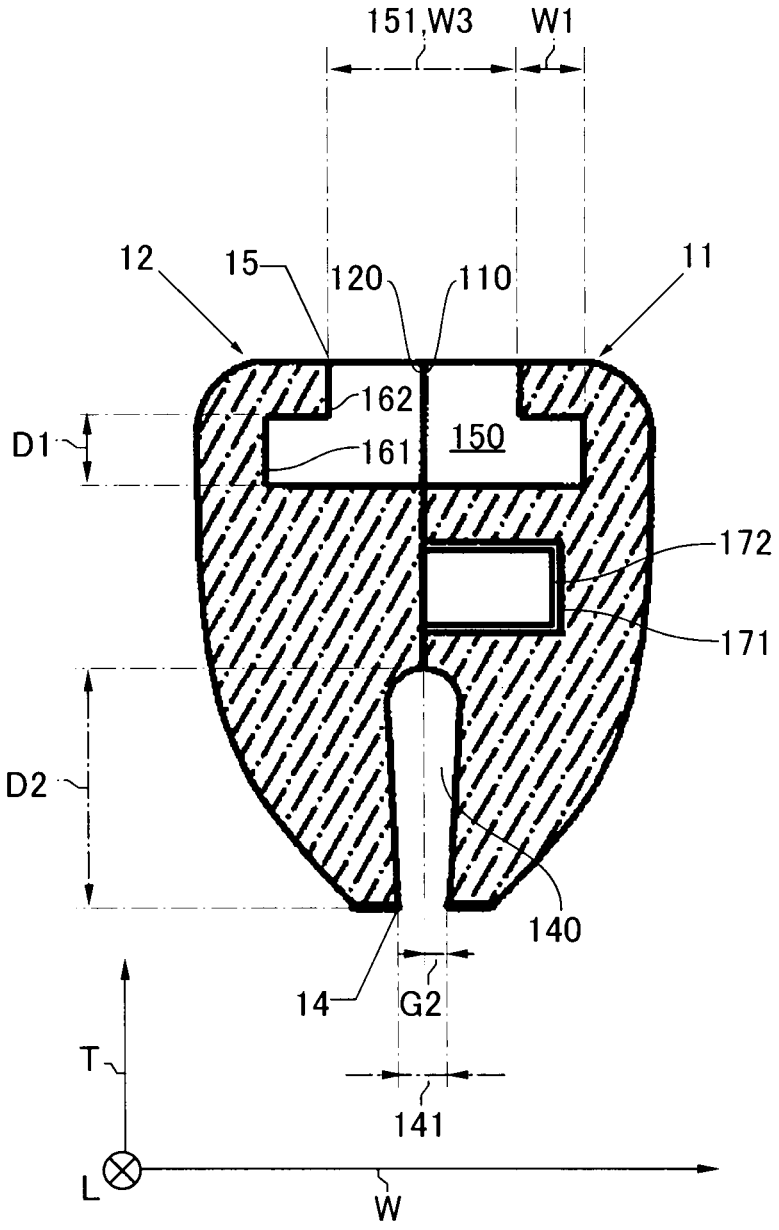
FIG. 7 is a partially omitted sectional view showing a front end portion of a body member of the multi-purpose hair cutter in FIG. 1.

The storage space 150 is defined by the inner faces 110, 120 opposed to each other in the width direction W. As shown in FIG. 7, the inner faces 110, 120 have a rugged surface structure conforming to the constricted shape of the projection member 3 and the finger rest member 4. More specifically, the inner face 110 of the second storage 15 has a first recessed step portion 161 and a second recessed step portion 162.

The first recessed step portion 161 has an opening at a position (D1) spaced apart from the upper end of the inner face 110 and has a bottom face at a position set back from the inner face 110 by the width W1 in the thickness direction. The second recessed step portion 162 appears at an interposed portion from the upper end of the inner face 110 to the upper end of the first recessed step portion 161 and has a difference in width W1 corresponding to a difference in position between the inner face 110 and the bottom face of the first recessed step portion 161. In other words, at a portion above the midpoint as seen in the height direction T, the inner face 110 is stepped corresponding to a difference in position (W1) between the bottom face of the first recessed step portion 161 and the bottom face of the second recessed step portion 162.

The inner face of the storage space 150 is symmetrical as seen from the left side face (FIG. 7). In short, the first recessed step portion 161 has an opening at a position (D1) spaced apart from the upper end of the inner face 120 and has a bottom face at a position set back from the inner face 120 by the width W1 in the thickness direction. The second recessed step portion 162 appears at an interposed portion from the upper end of the inner face 120 to the upper end of the first recessed step portion 161 and has a difference in width W1 corresponding to a difference in position between the inner face 120 and the bottom face of the first recessed step portion 161.

Figure 6:
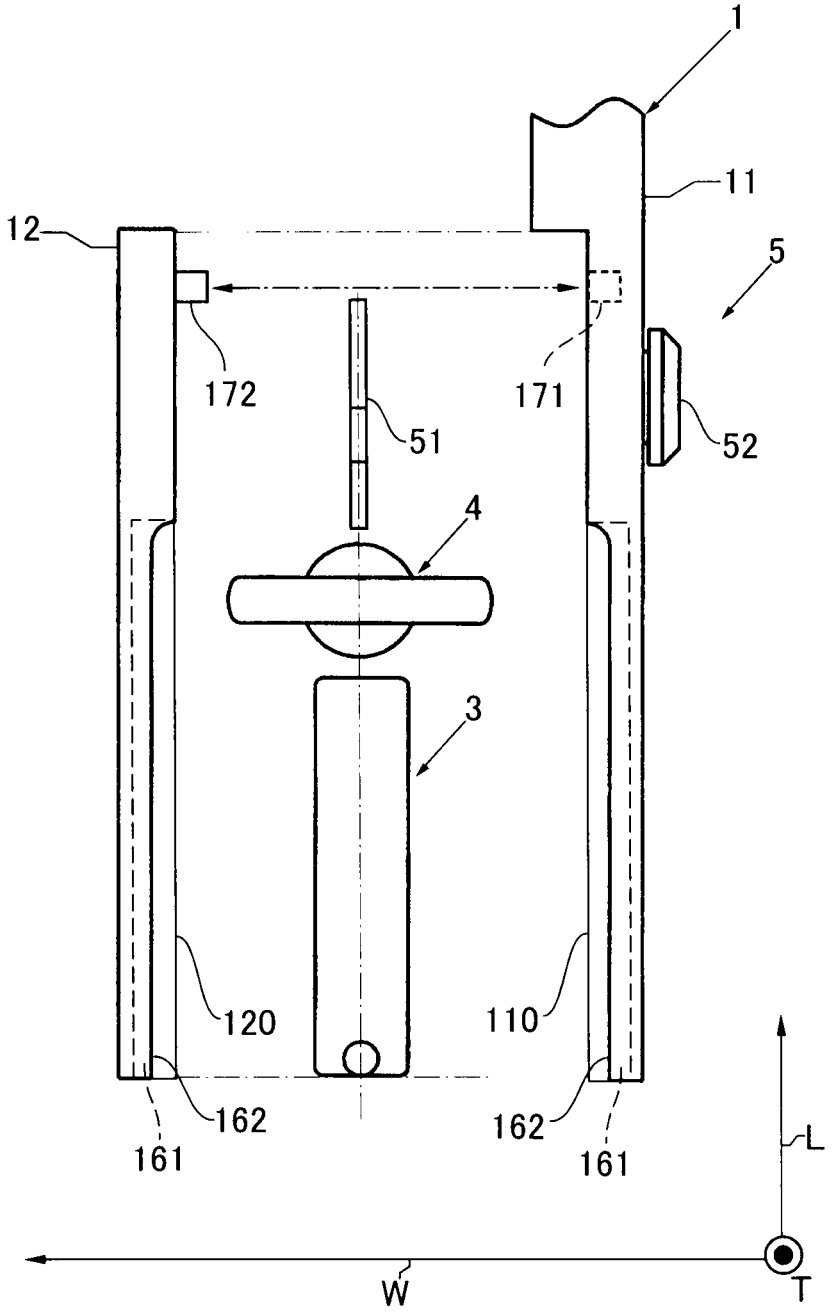
FIG. 6 is an exploded structural drawing showing a front end portion of the multi-purpose hair cutter in FIG. 1 on an enlarged scale.
Figure 8:
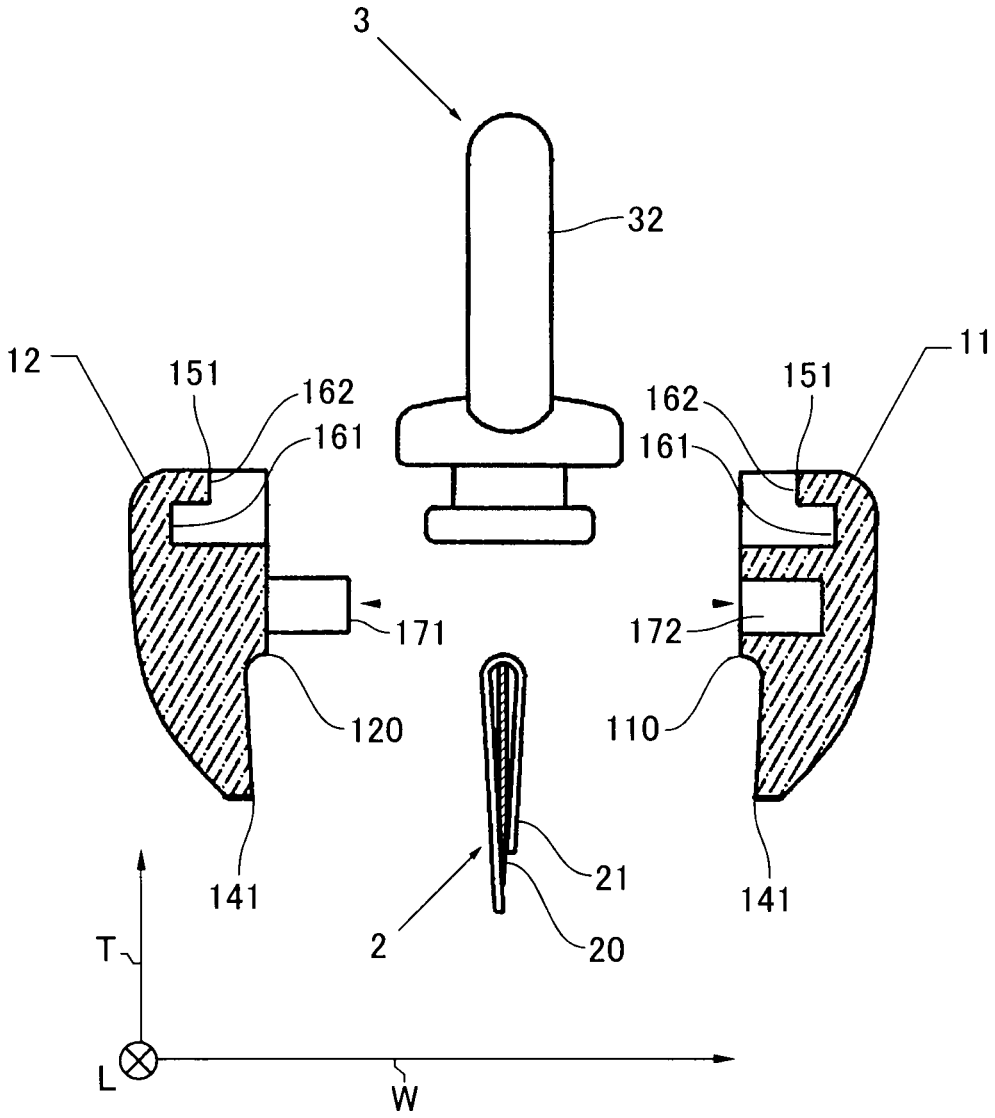
FIG. 8 is a partially omitted left side sectional view showing an exploded structure of the multi-purpose hair cutter in FIG. 1.

Referring to FIGS. 6 to 8, furthermore, the first and second body parts 11, 12 have a female fitting portion 171 and a male fitting portion 172 to achieve a male-female fit between the opposing faces 110, 120. With this structure, the storage space 150 conforming to the constricted shape of the projection member 3 and the finger rest member 4 can be formed between the opposing faces at the first and second recessed step portions 161, 162 with the male fitting portion 172 being fitted into the female fitting portion 171.

In the storage space 150, the distance between the opposing first recessed step portions 161 is made larger than the distance (W3) between the opposing second recessed step portions 162 by the width W1 in the width direction W. The open end 151 is in the form of a slit and extends along the longitudinal direction L at the upper side of the front end portion 101. Moreover, the open end 151 is defined by the upper sides of the second recessed step portions 162 as seen in the height direction T. These upper sides of the second recessed step portions 162 are opposed to each other across a gap (W3) which is twice the width W2 of the projection member 3 in the width direction W. In other words, the distance (W3) of the open end 151 as seen in the width direction W is narrowed by the width W1 from the distance between the opposing first recessed step portions 161.

The projection member 3 and the finger rest member 4 are detachably press-fitted into the storage space 150 from one end in the longitudinal direction L, and in this press-fitted state, the projecting part 32 and the ring part 42 are exposed outside of the open end 151.

In the multi-purpose hair cutter of FIGS. 5 to 8, moreover, the first body part 11 has a through hole 18 and a cavity 19. The cavity 19 is formed between the opposing faces 110, 120 at a midway position as seen in the height direction T. The through hole 18 is an elongate hole as seen from the front and has a major axis and a minor axis crossing each other, wherein the major axis extends along the longitudinal direction L. The through hole 18 opens within the area of the cavity 19 as seen from the front and leads to the cavity 19.

The slide member 5 has a push-out part 51 and an operation button 52. The push-out part 51 has a stepped portion 53 at a lateral edge appearing in the longitudinal direction L and is allowed to slide along the longitudinal direction L within the cavity 19 while being housed in the cavity 19. The operation button 52 is fixed with a shaft to the push-out part 51 through the through hole 18 and makes the push-out part 51 slide along the longitudinal direction L in this fixed state with the shaft. Next will be described how to operate the hair cutter with the slide member 5 with reference to FIGS. 9 to 11.

Figure 9:
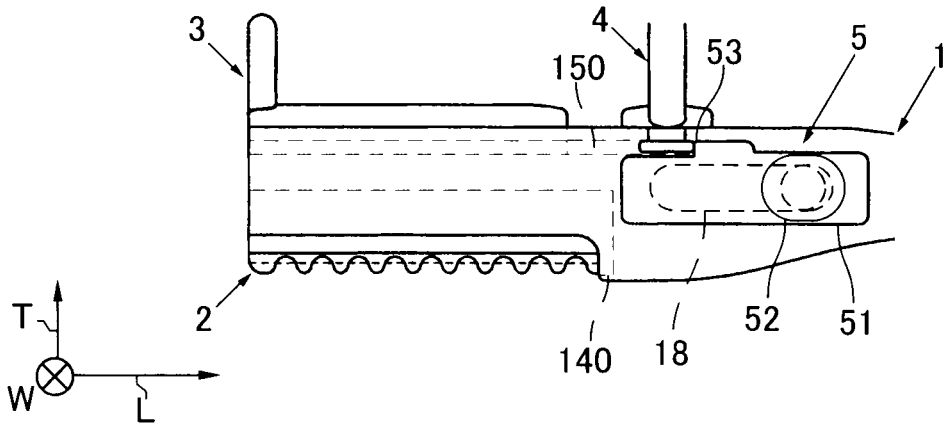
FIG. 9 is a partially omitted front view showing how to use a multi-purpose hair cutter according to one embodiment of the present invention.

FIG. 9 shows a state of the slide member 5 before pushing the blade member 2, the projection member 3, and the finger rest member 5, wherein the push-out part 51 is housed in the cavity 19 with its lateral edge located at one end of the blade member 2 and at one end of the finger rest member 4.

Figure 10:
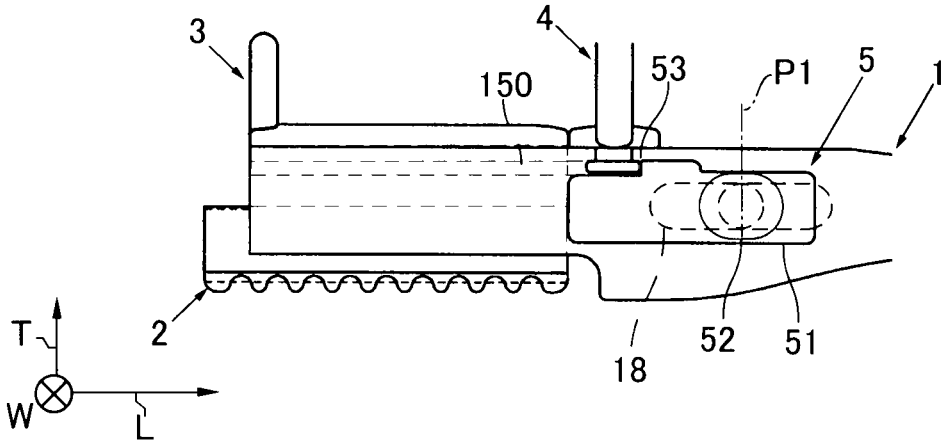
FIG. 10 is a partially omitted front view showing a step after the step shown in FIG. 9.

FIG. 10 shows a state after the blade member 2 is pushed out by operating the slide member 5 of FIG. 9, wherein the operation button 52 is slid from one end of the through hole 18 to a point P1 near the center thereof, thereby moving the push-out part 51 from one end of the cavity (19) to a middle position thereof to push the blade member 2. As a result, the blade member 2 is forcibly moved along the storage space 140 in the longitudinal direction L and pushed out from the tip of the front end portion 101. By catching the blade member 2 with fingers in this state, the blade member 2 can pulled out of the storage space 140.

Figure 11:
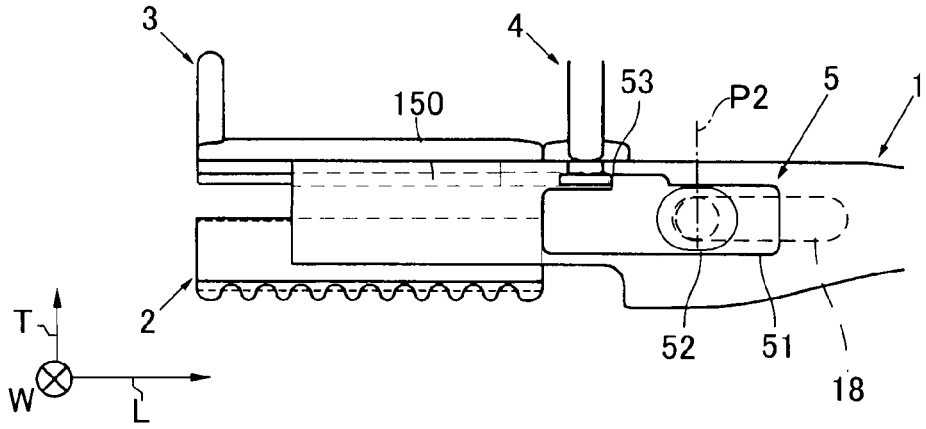
FIG. 11 is a partially omitted front view showing a step after the step shown in FIG. 10.

As shown in FIG. 11, furthermore, when the operation button 52 is slid from a point near the center of the through hole 18 to a point P2 close to the other end thereof, the finger rest member 4 is forcibly moved in the longitudinal direction L by the stepped portion 53 and then the projection member 3 pushed by the finger rest member 4 is pushed out from the tip of the front end portion 101. By catching the projection member 3 with fingers in this state, the projection member 3 can be pulled out of the storage space 150. Although not clearly depicted in FIG. 11, after pulling out the projection member 3, the finger rest member 4 may further be pulled out of the storage space 150.

As has been described with reference to FIGS. 1 to 11, since the blade member 2 is attached to the front end portion 101, the multi-purpose hair cutter according to one embodiment of the present invention permits cutting works according to a conventional technique, such as a stroke cut, in which a part of a hair bundle held with the left hand is cut by the blade member 2 upon swinging down the multi-purpose hair cutter with the rear end portion 102 being held with the right hand, for example.

One feature of the multi-purpose hair cutter of FIGS. 1 to 11 resides in that the projection member 3 is provided in addition to the above-mentioned basic hair cutter structure. The projection member 3 has the projecting part 32, and the projecting part 32 is formed to project from the upper side of the base part 310 and rises in the height direction H opposite to the cutting edge of the blade member 2. With this structure, a part of the hair bundle can be put aside in the above stroke cut by catching it with the projecting part 32 upon swinging up the multi-purpose hair cutter. That is, since a part of the hair bundle can be put aside during the up-and-down movement, the cutting work efficiency can be improved with the multi-purpose hair cutter of FIGS. 1 to 11.

Since the projection member 3 is detachably attached to the front end portion 101, a variety of hair designs can be achieved by properly replacing the projection member 3 in accordance with a desired hair design. As has been described with reference to FIGS. 9 to 11, furthermore, the detachment of the projection member 3 can easily be performed such that the hair cutter's user operates the operation button 52 with his thumb or another finger to slide in the longitudinal direction L.

Another feature of the hair cutter of FIGS. 1 to 11 resides in that the finger rest member 4 is provided in addition to the projection member 3. The finger rest member 4 is attached adjacent to a rear end of the projection member 3 in the second storage 15. The ring part 42 of the finger rest member 4 is formed to project from the upper side of the base part 410 and rises in a direction (T) opposite to the cutting edge of the blade member 2. In this structure, when a right index finger is inserted into the ring part 42, for example, the insertion direction of the index finger and the extension direction of the blade member 2 coincide with each other in the longitudinal direction L, so that the cutting edge of the blade 20 extends along the direction indicated by the index finger. As a result, upon swinging down the multi-purpose hair cutter, for example, the direction of the blade 20 can be recognized based on the direction indicated by the index finger to fine-tune the angle of the blade 20 with respect to the hair, so that the accuracy of the cutting work can be improved. This makes it possible to achieve a variety of hair designs.

Furthermore, when the right index finger is inserted into the ring part 42, the back of the index finger (the back of the hand) comes into contact with the inner face of the ring part 42, whereby the hair cutter is suspended as a whole. As a result, the hair cutter can be certainly held without the need of tightly gripping the grip, so that the accuracy of the cutting work can be improved. This makes it possible to achieve a variety of hair designs.

Figure 12:
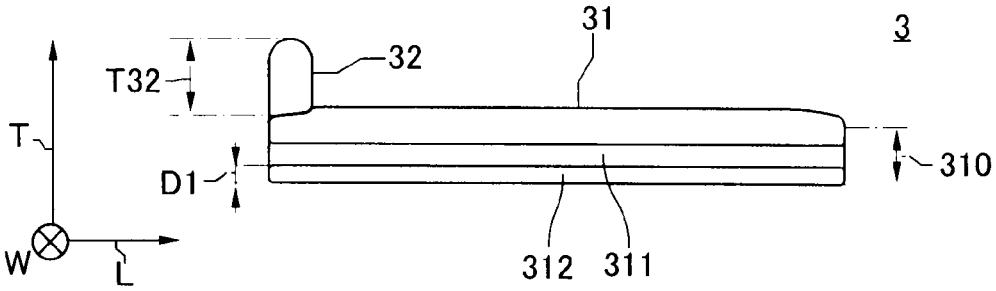
FIG. 12 is a front view showing another embodiment of the projection member of the multi-purpose hair cutter according to the present invention.
Figure 13:
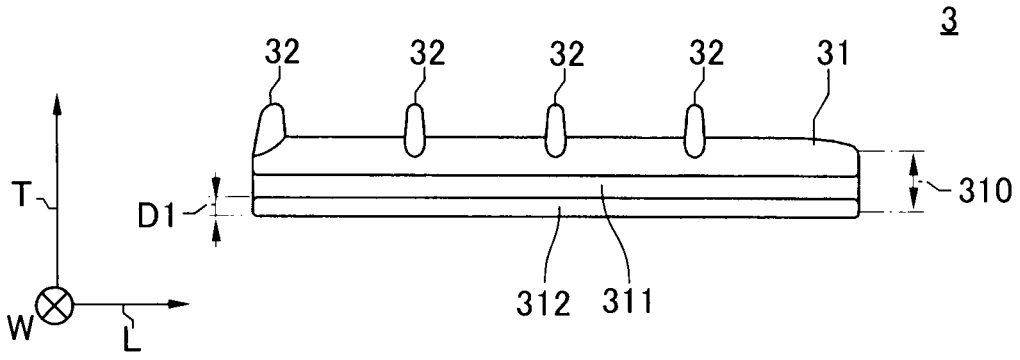
FIG. 13 is a front view showing still another embodiment of the projection member of the multi-purpose hair cutter according to the present invention.
Figure 14:
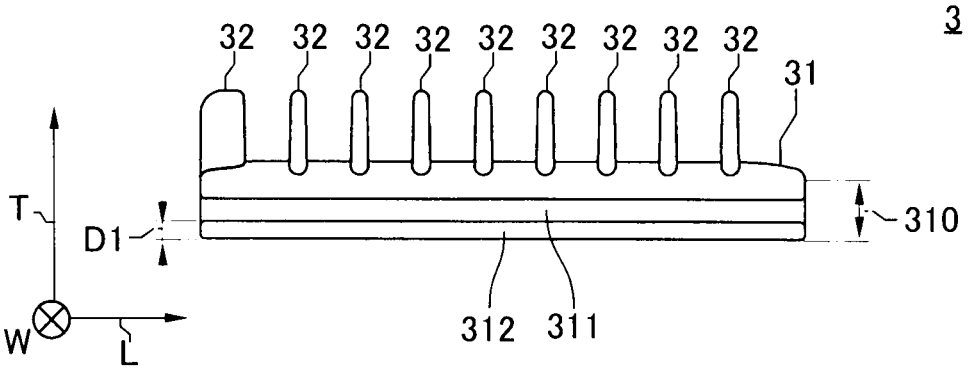
FIG. 14 is a front view showing yet another embodiment of the projection member of the multi-purpose hair cutter according to the present invention.

FIGS. 12 to 14 are embodiments showing variations of the projection member 3 of FIGS. 1 to 11. Since the projection member 3 is detachably attached to the body member 1, as has been described with reference to FIGS. 1 to 11, the projection member 3 can be replaced in accordance with a desired hair design. Hereinbelow, description will be made mainly about differences from FIGS. 1 to 11.

In the embodiment of FIG. 12, a height T32 of the projecting part 32 is about half of that of the projecting part 32 of FIGS. 1 to 11 and is, for example, 5 mm. If the projection member 3 of FIG. 12 is employed, for example, the cutting work efficiency can be improved for people with short hair In the embodiment of FIG. 13, four projecting parts 32 are arranged at intervals along the longitudinal direction L on the upper side of the base part 31 in the height direction T. In the embodiment of FIG. 14, nine projecting parts 32 are arranged at intervals along the longitudinal direction L in the form of a comb on the upper side of the base part 31 in the height direction T. According to the embodiments of FIGS. 13 and 14, the projection member 3 can be used as a comb to achieve a variety of hair designs.

Although a plurality of the projecting parts 32 are arranged at regular intervals in the embodiments of FIGS. 13 and 14, the distance between adjacent projecting parts 32 may be freely determined. For example, the position where hair is to be combed can be properly changed depending on a desired hair design by providing the projection member 3 with a portion having a small distance and a portion having a large distance between adjacent projecting parts 32.

Figure 15A:
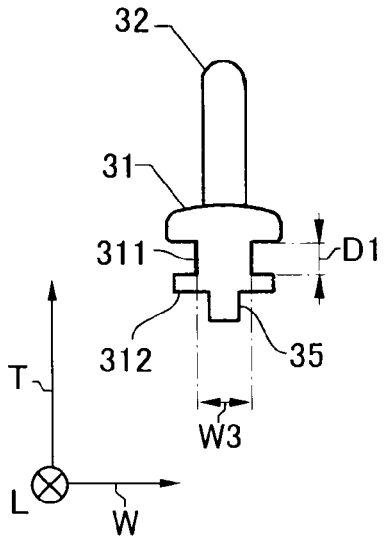
FIG. 15(*a*) is a left side view showing yet another embodiment of the projection member of the multi-purpose hair cutter according to the present invention, FIG. 15(*b*) is a front view of the same projection member, and FIG. 15(*c*) is a bottom view of the same projection member.
Figure 15B:
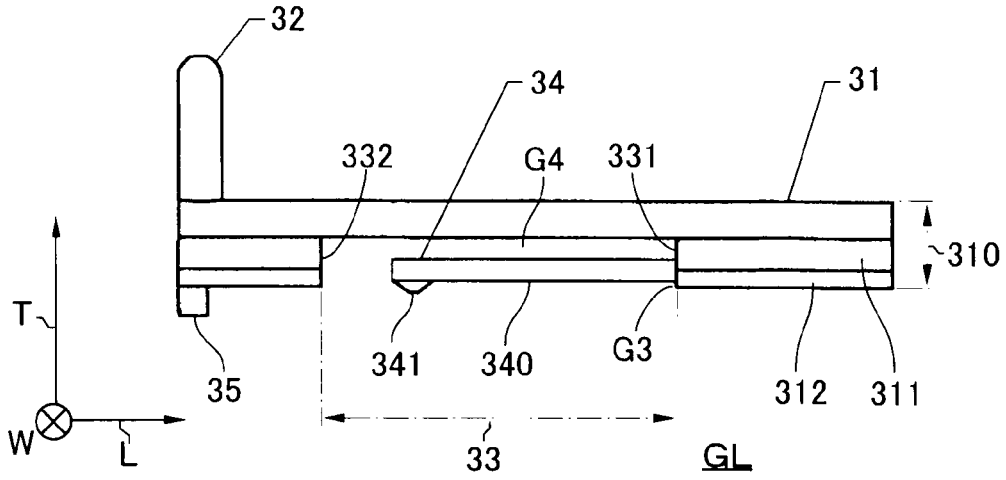
Figure 15C:
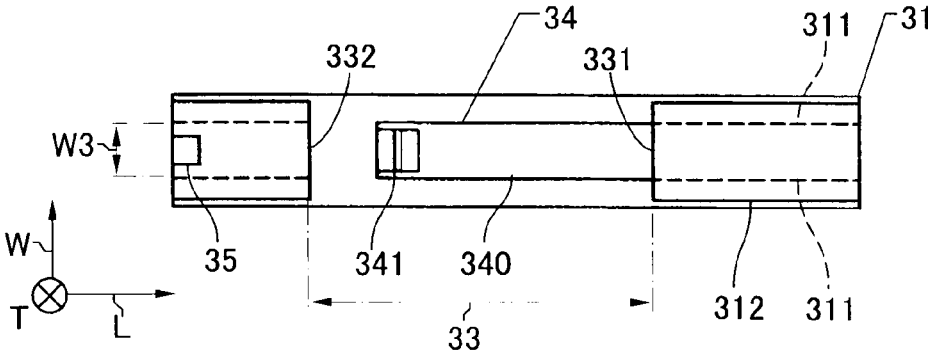

The projection member of FIGS. 15(*a*) to 15(*c*) is characterized in that the structure at the lower portion of the base part 31 is different from that of the embodiment of FIGS. 1 to 14. Hereinbelow, description will be made mainly about differences from FIGS. 1 to 14.

The projection member of FIGS. 15(*a*) to 15(*c*) has a cut-out space 33, a retaining portion 34, and an engaging portion 35. The cut-out space 33 is a space in the shape of a recess as seen from the front (b) and has an opening, a ceiling and two inner faces 331, 332 and opens downwardly in the height direction T at a midway position of the base part 31 as seen in the longitudinal direction L. The ceiling coincides with the upper side of the recess 311 and is opposed to the opening in the height direction T. The two inner faces 331, 332 rise along the height direction T from both ends of the ceiling as seen in the longitudinal direction L and are opposed to each other in the longitudinal direction L.

The retaining portion 34 is a so-called damper and has an arm 340 and a retaining claw 341. The arm 340 extends parallel to the ceiling from the inner face 331 along the longitudinal direction L. The arm 340 has one end integrally connected to the inner face 331 as a fixed end and the other end spaced apart from the inner face 332 as a free end.

Moreover, the arm 340 has a width (W3) corresponding to the constricted portion between the recesses 311, 311 opposed to each other in the width direction W as seen from the bottom (c). The arm 340 has a lower face spaced a distance G3 apart from the bottom face of the base part 31 in the height direction T and an upper face spaced a distance G4 apart from the ceiling in the height direction T. With this structure, the arm 340 can make up-and-down movements along the height direction T like a leaf spring within the range of the distances G3, G4 in response to an external pressing force.

The retaining claw 341 is formed to project from the lower face of the arm 340 in the height direction T at the other end in the longitudinal direction L and has a tip projecting from the opening to the outside. The retaining claw 341 is integrally connected to the lower face of the arm 340.

The engaging portion 35 is formed to project from the lower side of the base part 31 in the height direction T at one end in the longitudinal direction L and rises in the height direction T opposite to the projection portion 32. The engaging portion 35 is integrally connected to the bottom face of the base part 31.

Figure 16:
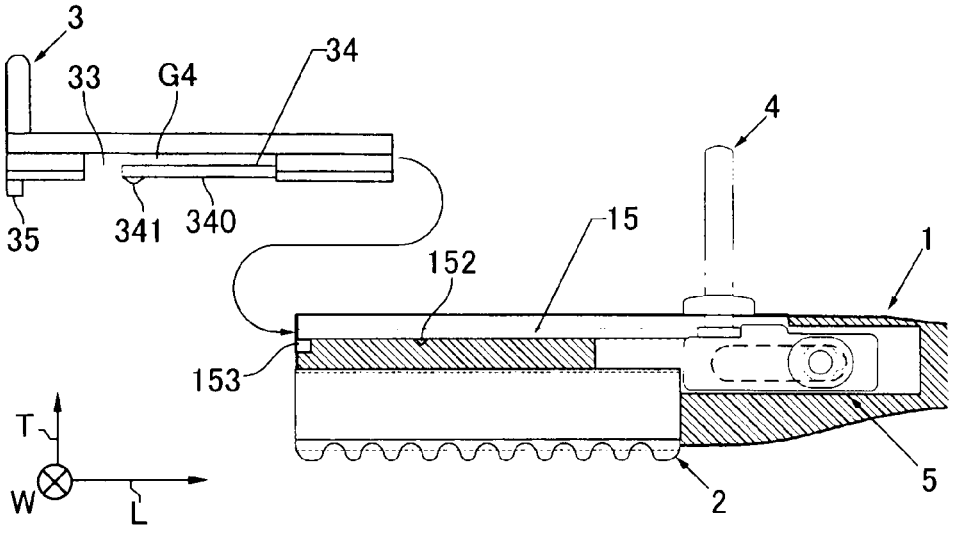
FIG. 16 is a partially omitted, partially sectional view showing how to attach the projection member in FIG. 15.

Next will be described the purpose, interrelation, and function of the retaining portion 34 and the engaging portion 35 with reference to FIGS. 16 to 18. FIG. 16 shows a state before the projection member 3 is attached to the second storage 15. At its bottom face, the second storage 15 of FIG. 16 has a retaining groove 152 and an engaging hole 153. The retaining groove 152 is formed at a midway position of the second storage 15 as seen in the longitudinal direction L and has a recessed shape which can make a fit with the retaining claw 341. The engaging hole 153 is formed at one end of the second storage 15 as seen in the longitudinal direction L and has a recessed shape which can make a fit with the engaging portion 35.

Figure 17:
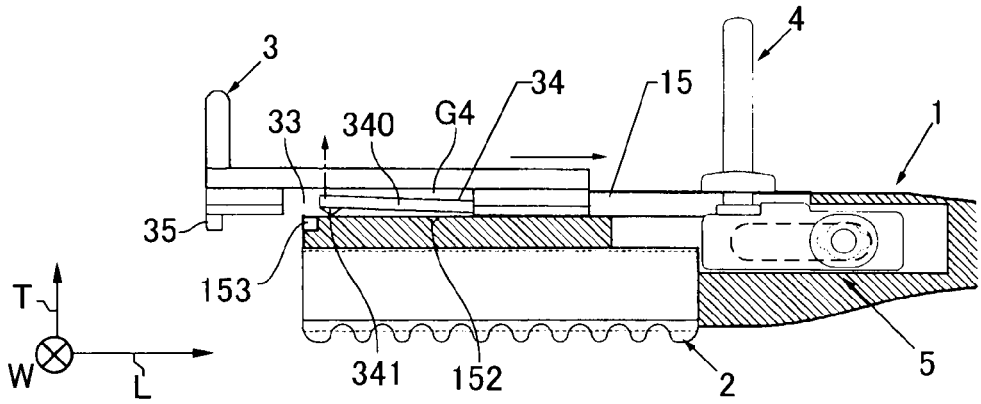
FIG. 17 is a partially omitted, partially sectional view showing a step after the step shown in FIG. 16.

FIG. 17 shows a state during insertion of the projection member 3 into the second storage 15. As shown in FIG. 17, when the projection member 3 is introduced into one end of the second storage 15, the retaining claw 341 comes into contact with the bottom face of the second storage 15, and the arm 340 is pushed up in the height direction T and retracted into the distance G4 by the pressing force transmitted through the retaining claw 341 from the bottom face of the second storage 15.

Figure 18:
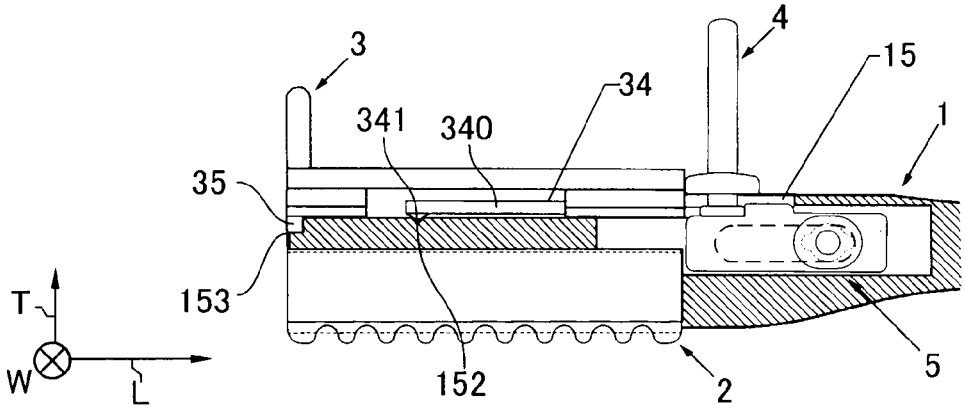
FIG. 18 is a partially omitted, partially sectional view showing a step after the step shown in FIG. 17.

Then, as shown in FIG. 18, as the projection member 3 is further inserted into the second storage 15, the engaging portion 35 is fitted within the engaging hole 153 to stop the insertion of the projection member 3, and at its stopped position, the retaining claw 341 is fitted within the retaining groove 152 to fix the projection member 3 within the second storage 15.

As has been described with reference to FIGS. 16 to 18, since the projection member 3 of FIG. 15 has the engaging portion 35, the engaging portion 35 serves as a stopper. Accordingly, the projection member 3 can be attached to a proper position of the second storage 15.

Furthermore, since the projection member 3 of FIGS. 15(*a*) to 15(*c*) is fixed within the second storage 15 by the retaining portion 34, a physical impact exerted from the outside during the cutting work does not cause a problem of undesirable falling off of the projection member 3. Here, needless to say, the projection member 3 can easily be detached by the procedure described with reference to FIGS. 9 to 11.

Figure 19:
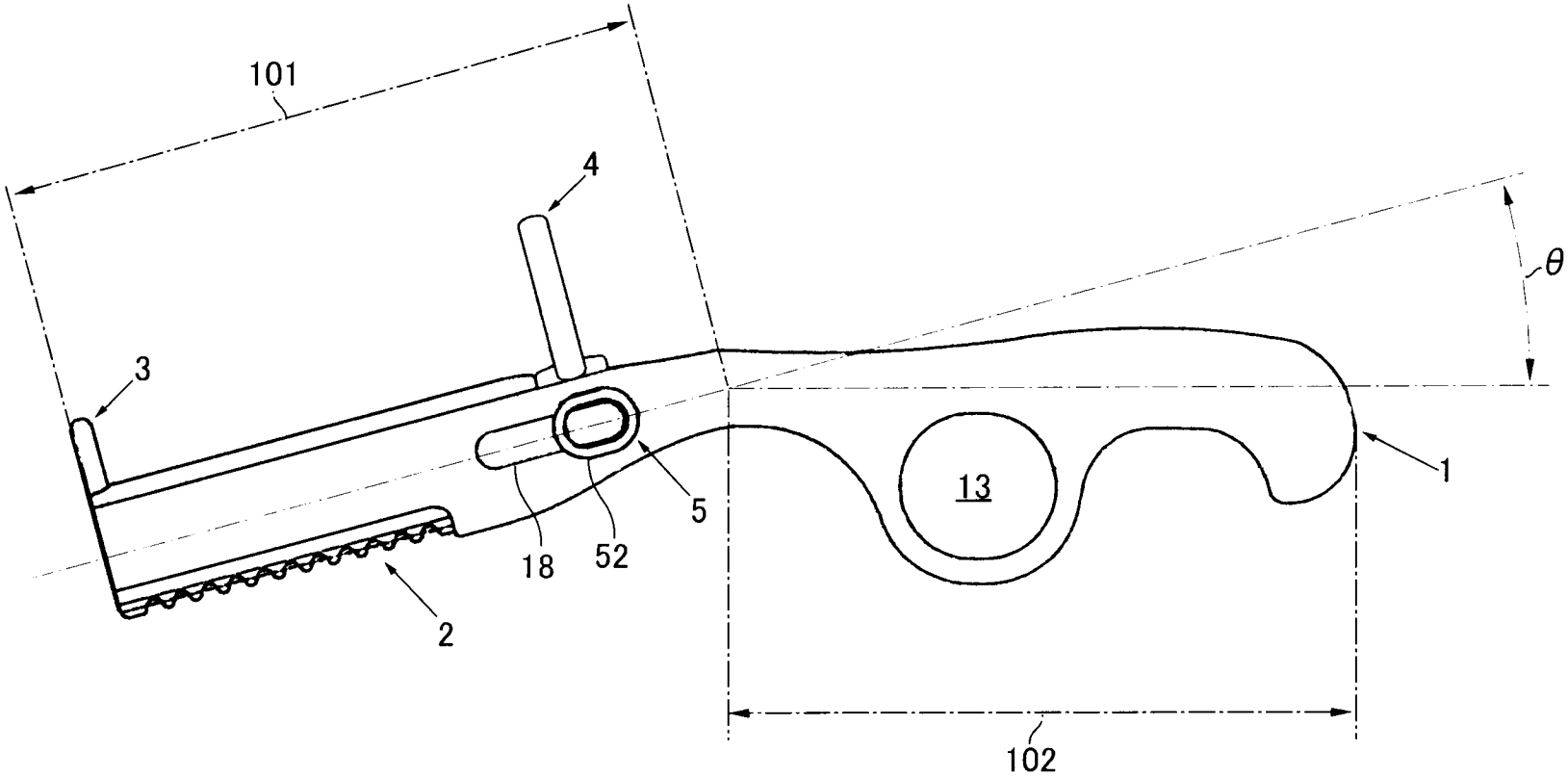
FIG. 19 is a front view of a multi-purpose hair cutter according to still another embodiment of the present invention.

The embodiment of FIG. 19 is characterized in that the body member 1 has a different shape from that of the multi-purpose hair cutter of FIG. 1. Hereinbelow, description will be made with reference to FIG. 19 mainly about differences from FIG. 1.

The body member 1 of FIG. 19 is bent at a midway position as seen in the longitudinal direction L such that the front end portion 101 is inclined downwardly with respect to the rear end portion 102. In other words, the body member 1 of FIG. 19 is bent in such a direction that the blade member 2 attached to the front end portion 101 comes closer to the ring-shaped opening 13 of the rear end portion 102. In FIG. 19, a downward inclination angle θ is set to 15 degrees, but it should not be construed as limited thereto and may be properly adjusted within the range of 0 to 30 degrees. For example, when the multi-purpose hair cutter is exclusive to the stroke cut, the downward inclination angle θ may be set to 30 degrees.

According to the embodiment of FIG. 19, when the index finger is inserted into the through hole (420) of the finger rest member 4 while holding the rear end portion 102 forming the grip, the angle between the back of the hand and the index finger (the downward inclination angle θ) can be ensured to improve the holdability from the ergonomic viewpoint. This results in improving the work efficiency.

According to the embodiment of FIG. 19, moreover, upon swinging up and down (or back and forth) with a pivot point at a wrist or an elbow while holding the rear end portion 102 forming the grip, the swing width of the front end portion 101 can be increased by the downward inclination. This results in improving the work efficiency.

Figure 20:
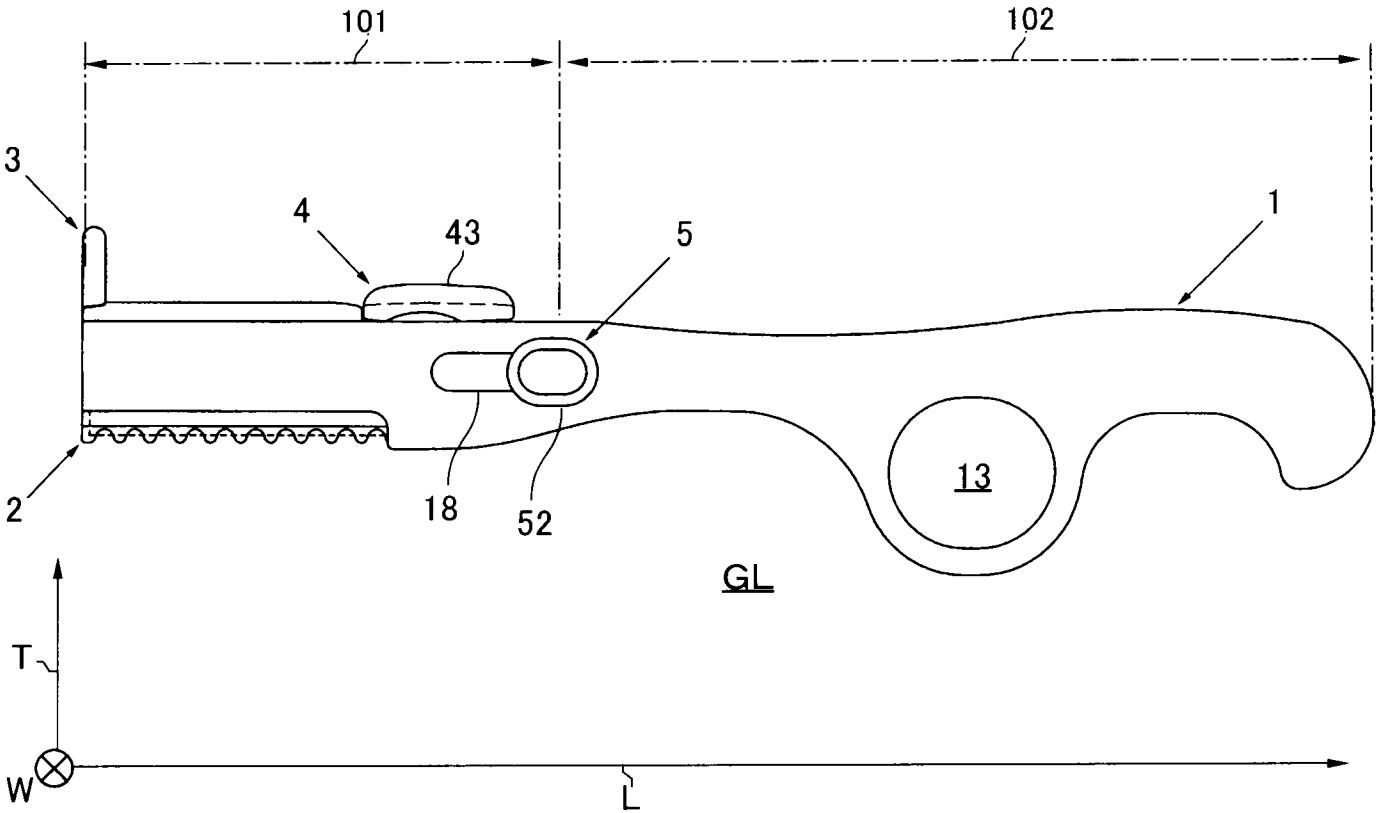
FIG. 20 is a front view of a multi-purpose hair cutter according to yet another embodiment of the present invention.

The embodiment of FIG. 20 is characterized in that the finger rest member 4 has a different structure from that of the multi-purpose hair cutter of FIG. 1. Hereinbelow, description will be made with reference to FIG. 20 and FIGS. 21(*a*) to 20(*c*) mainly about differences from FIG. 1.

Figure 21A:
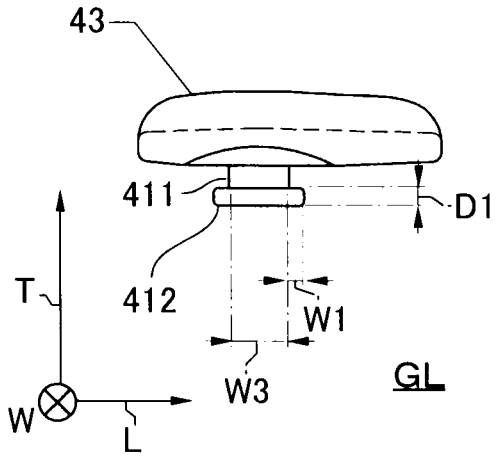
FIG. 21(*a*) is a front view selectively showing the finger rest member in FIG. 20, FIG. 21(*b*) is a bottom view of the same finger rest member, and FIG. 21(*c*) is a left side view of the same finger rest member.
Figure 21B:
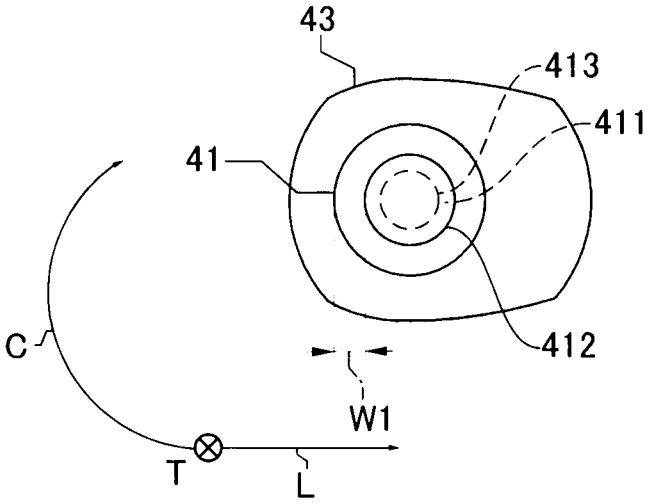
Figure 21C:
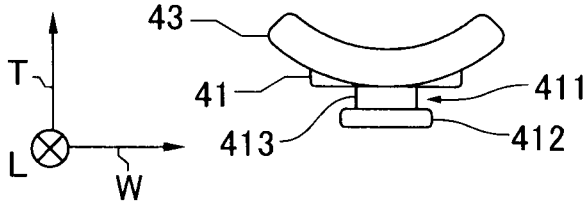

The finger rest member 4 of FIGS. 21(*a*) to 20(*c*) is integrally molded of a synthetic resin such as AS resin (AS), ABS resin (ABS), polycarbonate (PC), polyethylene (PE), and polypropylene (PP) to have the base part 41 and a finger receiving dish part 43.

The finger receiving dish part 43 has a concavely curved top face and is formed above the base part 41 in the height direction T. Since the finger receiving dish part 43 is intended for a hair cutter's user to put a finger thereon, the curvature of the finger receiving dish part 43 may be properly determined depending on sex of an expected user, particularly, an finger thickness of the hair cutter's user.

At the lower portion of the base part 41 in the height direction T, there is formed the same constricted portion as described with reference to FIGS. 3(*a*) to 3(*c*) and FIGS. 4(*a*) to 4(*c*), and with this constricted portion makes, the finger rest portion 4 is detachably attached to the body member 1.

The embodiment of FIG. 20 and FIGS. 21(*a*) to 20(*c*) has all the same advantages as described with reference to FIGS. 1 to 19, too. Furthermore, since the finger rest portion 4 is detachably attached to the body member 1, hair cutter's users can freely change the structure of the multi-purpose hair cutter depending on each person's usability by replacing the finger rest member 4 of FIGS. 1 to 19 with the finger rest member 4 of FIGS. 20 and 21.

Figure 22:
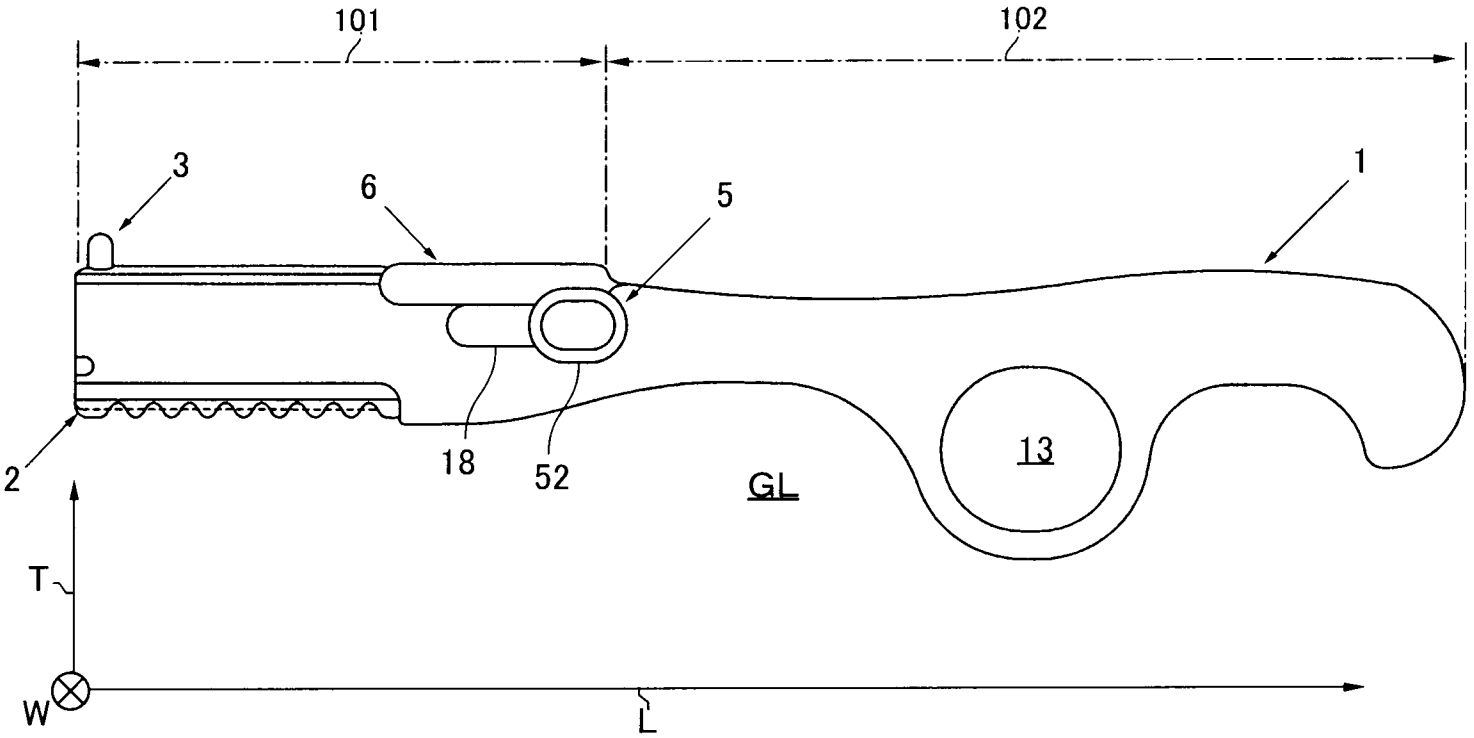
FIG. 22 is a front view of a multi-purpose hair cutter according to yet another embodiment of the present invention.

FIG. 22 is a front view of a multi-purpose hair cutter according to still another embodiment of the present invention and showing a structure where the finger rest member 4 is omitted. In the multi-purpose hair cutter of FIG. 22, the portion corresponding to the finger rest member 4 is covered with a cover member 6. Although not depicted in FIG. 22, the cover member 6 preferably has the same constricted portion as the projection member 3 and the finger rest member 4.

The embodiment of FIG. 22 also has all the same advantages as described with reference to FIGS. 1 to 19, because the multi-purpose hair cutter at least has the projection member 3.

The present invention has been described in detail above with reference to preferred embodiments. However, obviously those skilled in the art could easily devise various modifications of the invention based on the technical concepts underlying the invention and teachings disclosed herein.

What is claimed is:

1. A multi-purpose hair cutter comprising:

a blade member;

a projection member;

a finger rest member; and a body member, wherein the blade member is attached to a first side of the body member in a height direction, wherein the projection member includes a base part and at least one projecting part, the base part is attached to a second side of the body member opposite to the blade member in the height direction and includes a longitudinal axis extending along a longitudinal axis of the body member, the projecting part projects from the base part and the body member to extend in a direction opposite to the blade member such that the projecting part catches a hair upon swinging up the multi-purpose hair cutter, and the projecting part is formed as a tooth of a comb, wherein the finger rest member has a second base part and a ring part, the second base part is attached to the second side of the body member opposite to the blade member in the height direction, and the ring part is formed to project from the second base part and rises in the direction opposite to the blade member, and wherein the body member includes a storage space, a cavity, and a through hole, the storage space extends along a longitudinal axis of the body member from the cavity, the through hole opens within an area of the cavity, and the base part of the projection member and the second base part of the finger rest member are provided within the storage space.

2. The multi-purpose hair cutter of claim 1, wherein the projection member is detachably attached to the body member.

3. The multi-purpose hair cutter of claim 2, further comprising a slide member within the cavity including a push-out part and a shaft, wherein the shaft is attached to the push-out part and extends through the through hole of the body member, and wherein a movement of the shaft within the through hole in a direction toward the finger rest member along the longitudinal axis causes the push-out part to slide in the cavity and push at least the second base part toward an end of the storage space.

4. The multi-purpose hair cutter of claim 1, further comprising a slide member within the cavity including a push-out part and a shaft, wherein the shaft is attached to the push-out part and extends through the through hole of the body member, and wherein a movement of the shaft within the through hole in a direction toward the finger rest member along the longitudinal axis causes the push-out part to slide in the cavity and push at least the second base part toward an end of the storage space.

* * * * *